US006881123B1

(12) United States Patent
Klakauskas

(10) Patent No.: US 6,881,123 B1
(45) Date of Patent: Apr. 19, 2005

(54) NATURAL SHAPE ENHANCING BRASSIERE

(76) Inventor: Dalius Klakauskas, 9848 Vidor Dr., #402, Los Angeles, CA (US) 90035

( * ) Notice: Subject to any disclaimer, the term of this patent is extended or adjusted under 35 U.S.C. 154(b) by 0 days.

(21) Appl. No.: 10/684,415

(22) Filed: Oct. 15, 2003

(51) Int. Cl.[7] ..... A41C 3/00
(52) U.S. Cl. ..... 450/39; 450/57
(58) Field of Search ..... 450/38, 39, 54–57, 450/40–44; 623/7, 8; 2/455, 463, 92, 73, 78.1–78.4, 267; 156/245; 264/257, 258, 291, 292, 294, 145, 148, 152–157, 160, 163

(56) References Cited

U.S. PATENT DOCUMENTS

| | | | | |
|---|---|---|---|---|
| 2,061,268 A | * | 11/1936 | Becker | 450/39 |
| 2,061,281 A | | 11/1936 | Becker | |
| 2,515,601 A | * | 7/1950 | Hughes | 450/56 |
| 2,563,241 A | * | 8/1951 | Herbener | 450/55 |
| 2,669,719 A | * | 2/1954 | Steiner | 450/39 |
| 2,727,278 A | * | 12/1955 | Thompson | 264/46.4 |
| 2,864,373 A | * | 12/1958 | Buckley | 450/57 |
| 3,190,292 A | | 6/1965 | Barnes | |
| 3,202,565 A | * | 8/1965 | Loftin | 428/175 |
| 3,285,247 A | * | 11/1966 | Morin | 450/55 |
| RE26,473 E | * | 10/1968 | Reynolds et al. | 156/245 |
| 5,098,330 A | | 3/1992 | Greenberg | |
| 5,522,892 A | | 6/1996 | Lin | |
| 6,136,027 A | | 10/2000 | Jackson | |
| 6,156,065 A | | 12/2000 | Eaton | |

OTHER PUBLICATIONS

J.C.Penney Catalog, Spring–Summer 2004; pp. 181, items I,J,K and 185, items J,K.*

* cited by examiner

*Primary Examiner*—Gloria M. Hale
(74) *Attorney, Agent, or Firm*—Peter A. Borsari

(57) ABSTRACT

A natural shape enhancing brassiere comprising a pair of idealized-shaped breast cups centrally joined and supported on a woman's upper chest by use of a surrounding band and, optionally, shoulder straps. Each idealized-shaped breast cup is in the form of a multi-layer construction comprising an intermediate foam layer configured with an idealized upper breast slant and an idealized lower breast convex curve, an outer shell layer composed from a material capable of conforming to the intermediate foam layer and an inner lining layer.

4 Claims, 4 Drawing Sheets

NATURAL SHAPE ENHANCING BRASSIERE

FIELD OF INVENTION

The present invention generally relates to a brassiere. More specifically, the present invention relates to a brassiere of the padded type which enhances the natural shape of the breast and bustline.

BACKGROUND OF THE INVENTION

A brassiere serves the primary function of providing support to a woman's breast tissue. A secondary, but often equally important, function of a brassiere it to bestow a perceived improvement in the presentation of a woman's breasts and bustline. At its simplest, a brassiere consists of a pair of breast cups which mold themselves about a woman's breasts and which are supported on the body by a harness. Typically, this harness includes a band surrounding the woman's upper chest and straps connecting from the top of the breast cups, passing over the shoulders and joining or merging to the band at some position along the woman's back.

The public presentation of a clad woman's bustline is a subject which, from antiquity to present has engendered interest in both men and women. Clothing lines are designed to not only accommodate a woman's bustline, but also to enhance the appearance thereof, even at the expense of comfort. The perception by an individual woman of her own bustline may be a source of pride, self-worth and empowerment. It also may be the source of consternation if her bustline does not meet her idealized expectations. While the natural achievement of an idealized bustline may be unrealistic, especially as a woman ages, the artificial fulfillment of such a desire has been pursued by various means.

The prior art is replete with brassieres which are designed to enhance the shape and size of a woman's breast. For example, U.S. Pat. No. 5,522,892 to Lin, issued Jun. 4, 1996 discloses a breast augmentation device composed of flexible rubber having a breast-shaped front part and a hollow, rounded rear part for covering a woman's breast. U.S. Pat. No. 5,098,330 to Greenberg, issued Mar. 24, 1992, discloses a breast enhancement brassiere wherein each of the cups is constructed with an inner pocket which receives a padding material, an outer pocket which receives a removable elastomeric member and a support wire, such that when the brassiere is worm, the wearer's breasts are lifted upwardly and inwardly towards each other for breast enhancement. U.S. Pat. No. 3,190,292 to Barnes, issued Jun. 22, 1965, discloses a bust forming brassiere comprising a pair of preformed bust cups composed of an organic foam material.

Breast-enhancing brassieres designed with artificial nipples also have been developed. For example, U.S. Pat. No. 3,285,247 to Morin, issued Nov. 15, 1966, discloses a brassiere having a pair of padded breast cups consisting of a polyether or polyethyl foam material forming a conic configuration and having a layer of embroidered material in which there is a central opening through which a rubber nipple projects, each of the components being sewed to form a single unit. U.S. Pat. No. 2,563,241 to Herbener, issued Aug. 7, 1951 and U.S. Pat. No. 2,061,268 to Becker, issued Nov. 17, 1936 also teach the use of padded brassiere assemblies augmented with an artificial nipple.

Breast prosthetic devices in the form of a brassiere also are well known in the prior art, such devices having a formed breast cup and artificial nipple, examples of which are disclosed in U.S. Pat. No. 6,136,027 to Jackson, issued Oct. 24, 2000 and U.S. Pat. No. 6,156,065 to Eaton, issued Dec. 5, 2002.

Despite the advances of the prior art, a need still exists for a brassiere which enhances the natural shape of the wearer's breasts. Such a brassiere should be create the illusion of an idealized bustline while providing comfort to wearer. In addition, such a brassiere should be provided with an artificial nipple integral with each breast cup in order to further enhance the idealized bustline. Further, such a brassiere should include an inner lining adapted to wick away perspiration and minimize chafing. Moreover, such a brassiere should be of simple yet durable construction to withstand multiple washings and normal use.

SUMMARY OF THE INVENTION

Accordingly, it is an object of the present invention to provide a brassiere which enhances the natural shape of the wearer's breasts by providing two ideally-shaped breast cups centrally joined and supported on a woman's upper chest by use of a surrounding band and, optionally, shoulder straps.

It is another object of the present invention to provide a brassiere having a multilayered construction which creates the illusion of an idealized bustline while being comfortable for the wearer.

It is an additional object of the present invention to provide, a brassiere which enhances the illusion of an idealized bustline by providing an artificial nipple integral with each breast cup.

It is a further object of the present invention to provide a brassiere wherein each breast cup includes an inner lining adapted to wick away perspiration and minimize chafing.

It is yet another object of the present invention to provide a brassiere of simple and durable construction which can withstand multiple washings and normal wear-and-tear.

Additional objects, advantages and novel features of the present invention will be set forth in part in the description which follows and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

These and other objects of the present invention are achieved by providing a brassiere comprising two ideally-shaped breast cups centrally joined and supported on a woman's upper chest by use of a surrounding band and, optionally, shoulder straps, wherein each breast cup is of a multi-layer construction including an inner layer adapted to wick away perspiration, and further comprising an idealized artificial nipple integral with each breast cup.

BRIEF DESCRIPTION OF THE DRAWINGS

The present invention will be better understood with reference to the appended drawing sheets, wherein.

DETAILED DESCRIPTION

Figure 1:
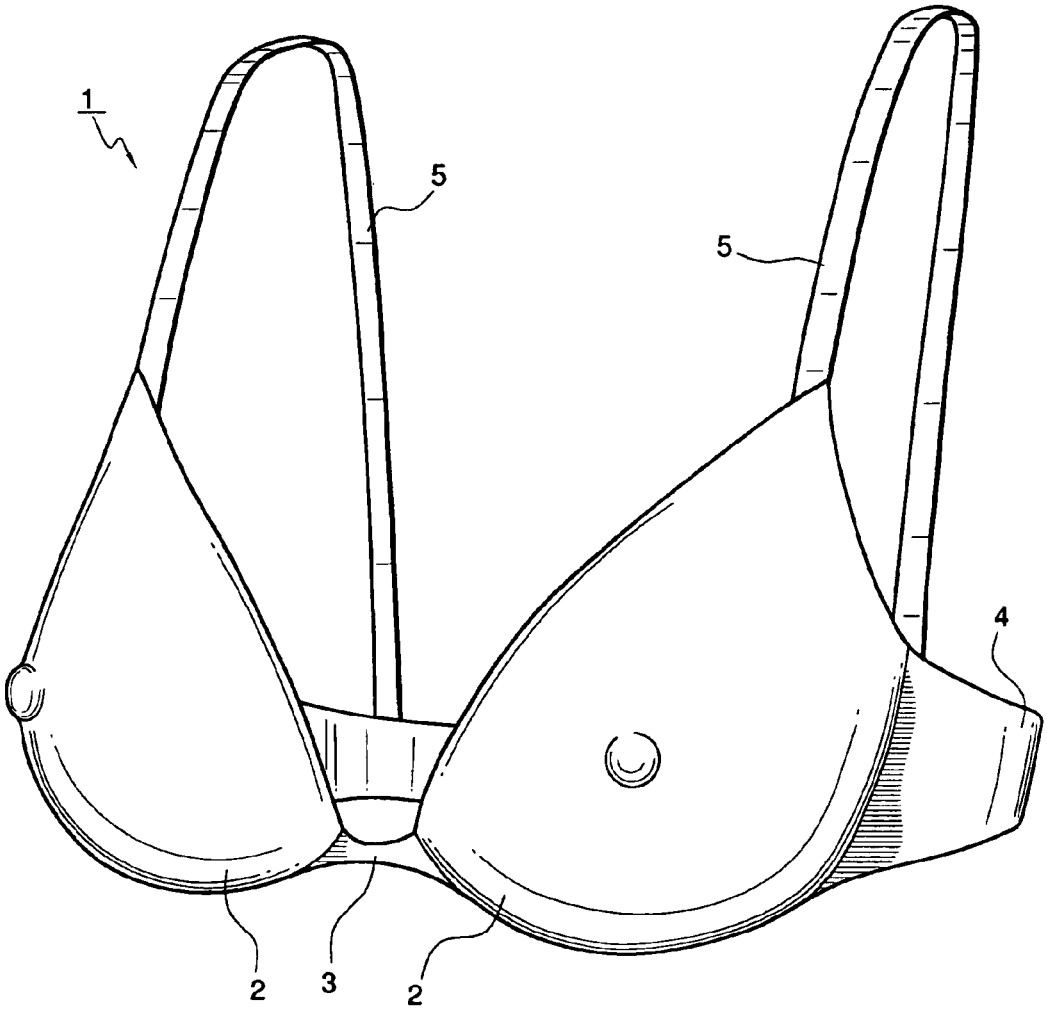
FIG. 1 is a front perspective view of the brassiere of the present invention.
Figure 2A:
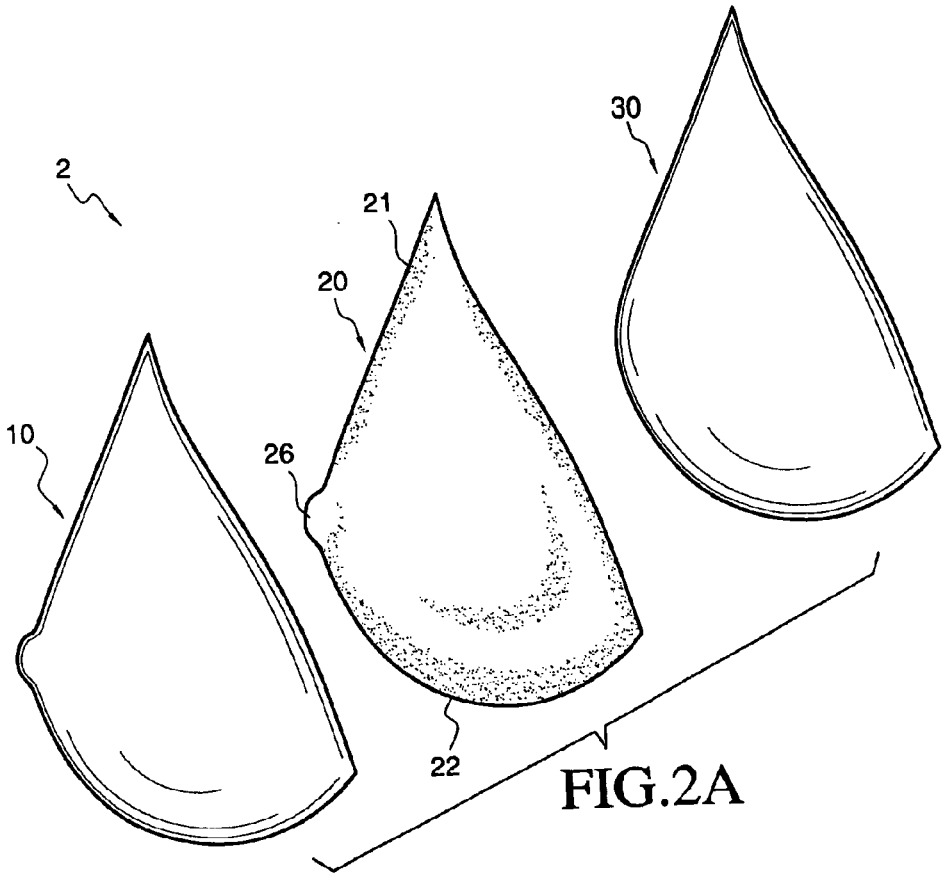
FIG. 2A is an exploded perspective view of a breast cup of the brassiere of the present invention.
Figure 2B:
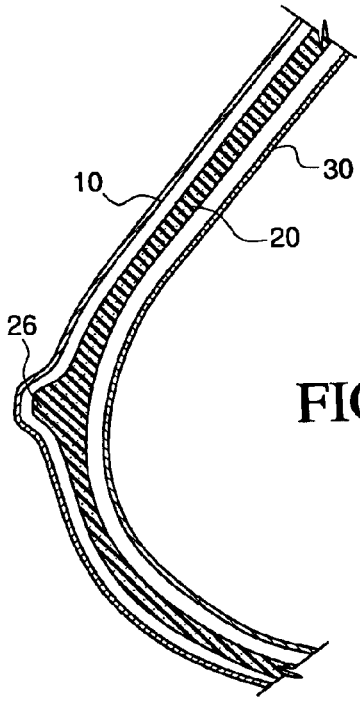
FIG. 2B is a side view of the breast cup of the brassiere of the present invention.

The present invention relates to a brassiere which enhances the natural shape of a woman's breast to create the illusion of an idealized bustline. The natural shape-enhancing brassiere 1 of the present invention comprises a pair of breast cups 2 joined to one another by a central band 3 and supported on a human body by a chest and back surrounding band 4 and, optionally, shoulder straps 5. It is to be understood that throughout this specification, the illustration of the brassiere with shoulder straps merely is a depiction of one embodiment and strapless brassieres are contemplated to be within the scope of this invention. Each breast cup 2 is in the form of a multi-layered structure comprising an outer shell layer 10, an intermediate foam enhancing layer 20 and an inner lining layer 30, as illustrated in FIGS. 2 and 2A.

The intermediate foam enhancing layer 20 is constructed with an upper breast slant 21, a lower breast convex curve 22 and an artificial nipple protrusion 26. The artificial nipple protrusion 26 is molded integrally within the foam enhancing layer. The artificial nipple protrusion is designed to offer the appearance of a woman's nipple, such that the brassiere, when worn by a woman under her public clothing, presents an idealized bustline. At a more discriminating level, the appearance of the nipple structure through the clothing enhances the illusion that the presented bustline is natural. The artificial nipple protrusion 26 also assists in situating the foam enhancing layer 20 in a proper position behind the outer shell layer 10.

Because the intermediate foam enhancing layer is adapted to present the idealized bustline through the wearer's clothing, the inherent rigidity of the fabric material should be considered as the overall breast cup must be rigid enough to provide the desired contour but supple enough to have a "natural" appearance. Consideration also should be given to the ability of the selected fabric to hold and present these idealized shapes after repeated wearing and laundering. Preferably, the foam enhancing layer 20 is in the form of a thin layer of foam. The thin layer of foam should be of a material which is sufficiently durable to withstand normal wear-and-tear, capable of wicking perspiration and which also is comfortable for the average wearer. The thin layer of foam also should be capable of retaining its shape after washing. Preferably, the thin layer of foam is composed of a hypoallergenic material. Suitable materials of the thin layer of foam include for example, polyester, polyurethane, ethylene vinyl acetate copolymer and polyethylene foams. A preferred material for the thin layer of foam used in the foam enhancing layer 20 is polyurethane. The foam enhancing layer 20 should be designed with a thickness sufficient to provide comfort to the wearer. The thickness at the upper breast slant 21 should be in the range of from about 1.0 to about 3.0 mm; thickness at the artificial nipple protrusion 26 should be in the range of from about 1.0 to about 1.3 cm; thickness at the lower breast convex curve 22 depends on the desired amount of lift and can be in the range of from about 1.0 mm to about 2.5 cm.

The intermediate foam enhancing layer 20 serves as a further cushioning and wicking layer between the inner lining layer 30 and the outer shell layer 10. The inclusion of the foam enhancing layer 20 offers an additional degree of comfort to the female wearer whose natural endowments may require some deformation in order to wear the brassiere. For example, in the instance of a woman having large or pendulous breasts, the padding serves to provide a comfortable support, whereas in the instance of a woman having relatively smaller breasts, the inherent rigidity of the brassiere materials provides an enhanced contour independently, requiring no support from the natural breast tissue. Because a woman's breasts may vary dramatically in shape, size and aspect from those of the idealized form presented by the intermediate layer 20, both the foam enhancing layer 20 and the inner lining layer 30 serve to comfortably contain and support the natural breast tissue which may be impinged upon by the breast cups 2.

The outer shell layer 10 is composed of a material that will readily conform to the shape of the intermediate foam enhancing layer 20. To achieve such conformity, the outer shell layer is composed of a soft stretch knit fabric, capable of stretching (molding) around the foam enhancing layer 20 and taking on the shape of the foam enhancing layer 20. Preferably, the outer shell layer is fabricated from a durable man-made fiber material, suitable examples of which include knit fabrics, nylon, nylon with spandex, polyester knits and polyester knits with spandex. The addition of spandex allows the outer layer to assume the shape of the intermediate layer 20, including the nipple area. In the instance where a non-spandex knit is used, the fabric should be stretched and heat-set into shape that forms around the intermediate layer.

The inner lining layer 30 also is configured to have a shape complementary to the intermediate foam enhancing layer 20. As the inner lining layer lies next to the wearer's skin, it should be composed of a material which provides comfort to the wearer and also is adapted to wick perspiration. Suitable examples of the inner lining layer include nylon, soft cotton and silk. The three layers, that is, the outer shell layer 10, the foam enhancing layer 20 and the inner lining layer 30, are permanently joined to one another, such as through sewing, to form the single multi-layered breast cup 2.

Figure 3A:
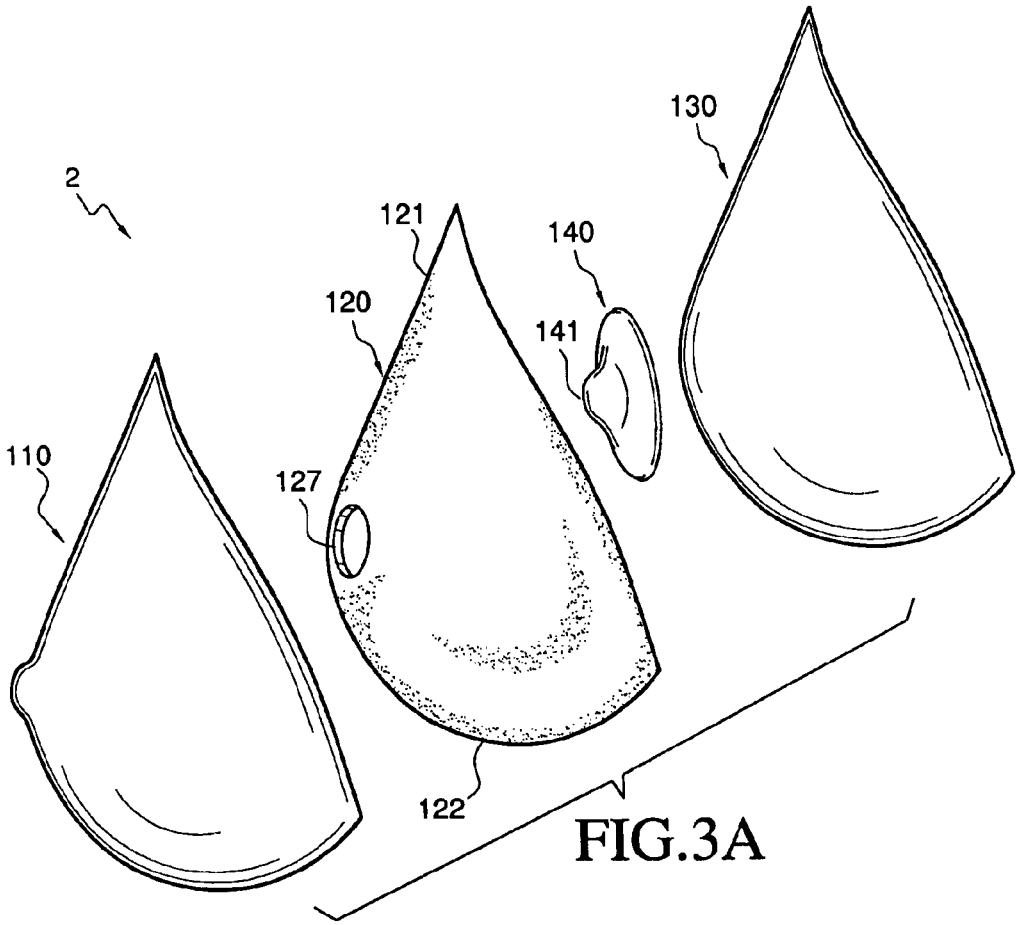
FIG. 3A is an exploded perspective view of a breast cup of an alternative embodiment of the brassiere of the present invention.
Figure 3B:
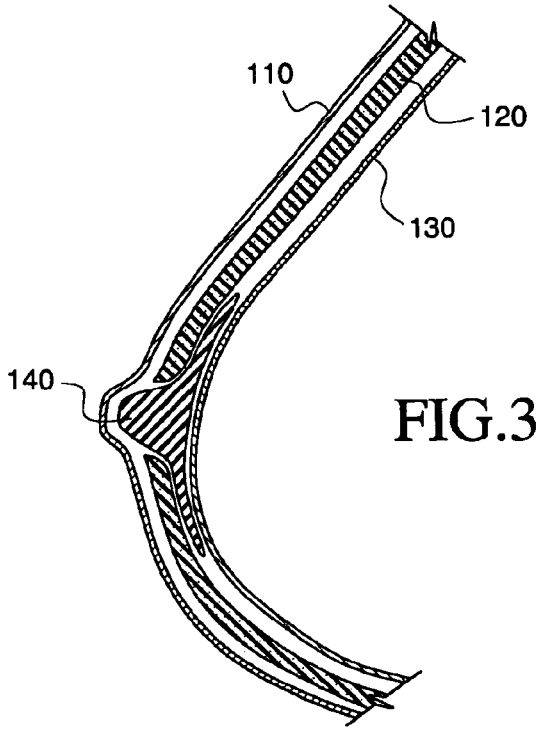
FIG. 3B is a side view of the breast cup of an alternative embodiment of the brassiere of the present invention.

Referring now to FIGS. 3 and 3A, a second embodiment of the natural shape enhancing brassiere of the present invention is shown. In this embodiment, each breast cup 2 is in the form of a multi-layered structure comprising an outer shell layer 110, an intermediate foam padding layer 120, a padded inner lining layer 130, and an artificial nipple 140. As in embodiment shown in FIGS. 2 and 2A, the foam padding layer 120 comprises an upper breast slant 121 and a lower breast convex curve 122 and a can be composed of the same materials as intermediate foam enhancing layer 20.

The intermediate foam padding layer 120 is provided with an aperture 127 adapted to receive the protruding end 141 of the artificial nipple 140. Suitable materials for use as the intermediate foam padding layer include for example, polyester, polyurethane, ethylene vinyl acetate and polyethylene foams.

The padded inner lining layer 130 also is configured to have a shape complementary to the foam padding layer 120. Preferably, the padded inner lining layer 130 is in the form of a thin layer of foam fused to a lining fabric. The thin layer of foam should be of a material which is sufficiently durable to withstand normal wear-and-tear, capable of wicking perspiration and which also is comfortable for the average wearer. In addition, the padded inner lining layer is adapted to obscure the contour of the inner part of the artificial nipple 140 such that it is not felt by the wearer. Preferably, either or both the thin layer of foam and the lining fabric are composed of a hypoallergenic material. Suitable materials of the thin layer of foam include for example, polyester, polyurethane, ethylene vinyl acetate and polyethylene foams. A preferred material for the thin layer of foam used in the padded inner lining layer 130 is polyurethane foam. The thin layer of foam material should have a thickness in the range of from about 1.0 to about 2.0 mm. Suitable materials for the lining fabric include for example, nylon, silk and soft cotton.

The artificial nipple 140 includes a protruding end 141 and is formed to emulate the idealized form of a female nipple, thereby enhancing the appearance of the bustline. The protruding end 141 of the artificial nipple 140 extends through aperture 127 disposed within the intermediate foam padding layer 120. The artificial nipple 140 can be composed of any material which is compressible under normal finger pressure, such as a soft rubber material. Suitable rubber materials include for example, silicone rubber and latex rubber, and natural rubber.

Figure 4A:
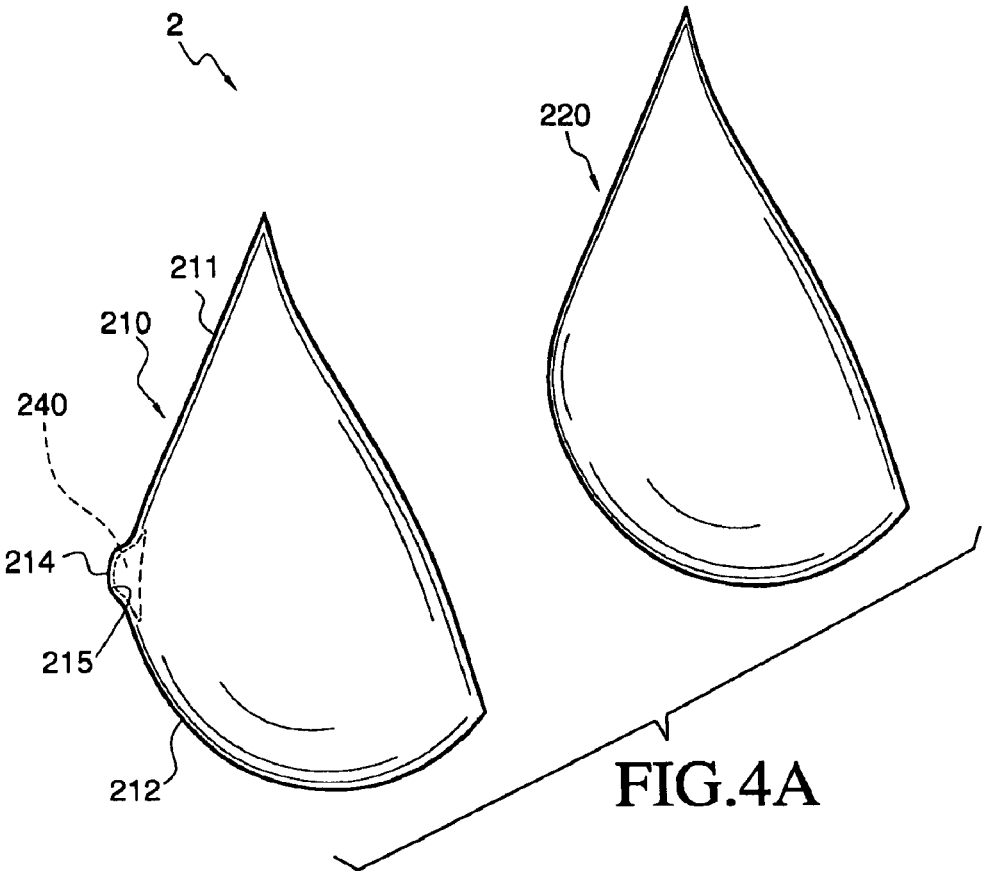
FIG. 4A is an exploded perspective view of a breast cup of another alternative embodiment of the brassiere of the present invention.
Figure 4B:
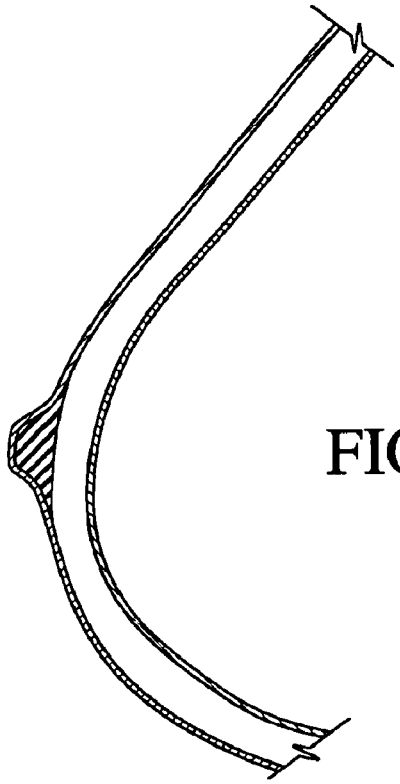
FIG. 4B is a side view of the breast cup of another alternative embodiment of the brassiere of the present invention.

Referring now to FIGS. 4 and 4A, a third embodiment of the natural shape enhancing brassiere of the present invention is shown. In this embodiment, each breast cup 2 comprises an outer shell layer 210 and an inner lining layer 220. The outer shell layer 210 comprises an idealized upper breast slant 211, a desirable lower breast convex curve 212 and a protruding nipple contour 214 which forms a nipple recess 215. The outer shell layer 210 should be constructed from a material which is moldable when heated and will retain its shape after cooling, a suitable example of which is a polyester. Once the outer shell layer is formed and cooled, the nipple recess 215 is filled with a liquid which is capable of hardening and adhering to the outer shell layer, thereby forming an artificial nipple 240. Suitable examples of such a liquid are liquid rubber and liquid silicone rubber. The inner lining layer 2220 should be adapted to wick perspiration and provide comfort for the wearer and can be composed of the same materials as inner lining layer 20.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. In a brassiere consisting of a pair of breast cups, each of said breast cups being joined to one another by a central band and being supported on a human chest by a surrounding band, each of said breast cups comprising:

(a) an outer shell layer having an idealized upper breast slant, an idealized lower breast convex curve, and a protruding nipple contour which forms a nipple recess, said nipple recess adapted to receive an artificial nipple forming liquid, and (b) an inner lining layer, said outer shell layer being composed from a material capable of being molded when heated and retaining its shape upon cooling, such that when that said nipple recess is filled with said artificial nipple forming liquid, an artificial nipple element is formed within said recess upon cooling and hardening of said artificial nipple forming liquid, said resulting artificial nipple element adhering to said nipple recess, and wherein said outer shell layer and said inner lining layer are permanently joined to one another to form a single breast cup.

2. The brassiere in accordance with claim 1 wherein said outer shell layer is fabricated from a polyester material.

3. The brassiere in accordance with claim 1, wherein said outer shell layer is fabricated from a knit fabricated selected from the group consisting of nylon knit fabrics and polyester knit fabrics.

4. The brassiere in accordance with claim 1, wherein said artificial nipple forming liquid is selected from the group consisting of liquid rubber and liquid silicone rubber.

* * * * *